US012490841B2

(12) United States Patent
Kamble et al.

(10) Patent No.: US 12,490,841 B2
(45) Date of Patent: Dec. 9, 2025

(54) UNIVERSAL CHIPS DISPENSER

(71) Applicant: Frito-Lay North America, Inc., Plano, TX (US)

(72) Inventors: Rahul Sadashiv Kamble, Faridabad (IN); Gurmeet Singh Bhutani, Gurgaon (IN); Amandeep Singh Gulati, New Delhi (IN)

(73) Assignee: Frito-Lay North America, Inc., Plano, TX (US)

( * ) Notice: Subject to any disclaimer, the term of this patent is extended or adjusted under 35 U.S.C. 154(b) by 208 days.

(21) Appl. No.: 18/277,531

(22) PCT Filed: Feb. 15, 2022

(86) PCT No.: PCT/US2022/016480
§ 371 (c)(1),
(2) Date: Aug. 16, 2023

(87) PCT Pub. No.: WO2022/177912
PCT Pub. Date: Aug. 25, 2022

(65) Prior Publication Data

US 2024/0138594 A1 May 2, 2024

(30) Foreign Application Priority Data

Feb. 17, 2021 (IN) ..... 202141006548

(51) Int. Cl.
*A47F 1/03* (2006.01)

(52) U.S. Cl.
CPC ..... *A47F 1/03* (2013.01)

(58) Field of Classification Search
CPC ..... A47F 1/03
USPC ..... 222/217
See application file for complete search history.

(56) References Cited

U.S. PATENT DOCUMENTS

| | | | | |
|---|---|---|---|---|
| 3,379,294 | A * | 4/1968 | Van Liew, Jr. | A47F 1/087 193/41 |
| 4,347,952 | A * | 9/1982 | Bookout | G07F 11/34 221/129 |
| 5,407,095 | A * | 4/1995 | Alli | G07F 11/28 221/312 R |
| 5,452,822 | A * | 9/1995 | Haymond | G07F 11/44 221/24 |
| 6,520,374 | B1 * | 2/2003 | Chang | G07F 11/54 221/195 |
| 6,551,183 | B2 * | 4/2003 | Knox, Jr. | G07F 11/14 453/18 |

(Continued)

FOREIGN PATENT DOCUMENTS

| | | |
|---|---|---|
| CN | 104346873 | 2/2015 |
| WO | 2018/057045 | 3/2018 |

OTHER PUBLICATIONS

International Search Report issued in PCT/2022/016480 on May 18, 2022.

(Continued)

*Primary Examiner* — David P Angwin
(74) *Attorney, Agent, or Firm* — Barnes & Thornburg LLP; G. Peter Nichols

(57) ABSTRACT

A universal snack dispenser capable of providing crisp snacks to customers offers a touchless experience and delivers a sufficient amount of the snacks independent of the type and container.

15 Claims, 12 Drawing Sheets

(56) References Cited

U.S. PATENT DOCUMENTS

| | | | | |
|---|---|---|---|---|
| 7,337,594 | B2 * | 3/2008 | Sus | B65B 43/305<br>53/502 |
| 2006/0113324 | A1 * | 6/2006 | Rudesill | A47F 1/035<br>222/132 |
| 2010/0012676 | A1 | 1/2010 | Freedman | |
| 2016/0379434 | A1 * | 12/2016 | Huang | G07F 17/0078<br>99/334 |
| 2019/0311567 | A1 | 10/2019 | Allegra et al. | |
| 2019/0311568 | A1 * | 10/2019 | Allegra | G07F 11/50 |

OTHER PUBLICATIONS

Written Opinion issued in PCT/2022/016480 on May 18, 2022.
Office Action issued on Jul. 24, 2025 in CN 2022800228006.

* cited by examiner

UNIVERSAL CHIPS DISPENSER

CROSS REFERENCE TO RELATED APPLICATION

This application is a U.S. nationalization under 35 U.S.C. § 371 of International Patent Application No. PCT/US2022/016480 filed Feb. 15, 2022, which claims priority to India application No. 202141006548 the entire contents of which are incorporated herein by reference.

The present disclosure relates generally to devices for dispensing snacks. More specifically, the present disclosure relates to a touchless universal dispenser of chips designed to maintain crispness and reduce chip breakage as the chips are dispensed.

BACKGROUND

Unlike popcorn machines, there are no widely available individualized chip dispensers from bulk product. Generally, customers purchase single servings of snacks in pre-packaged individualized serving amounts. For example, purchasing a bag of chips from a vending machine. The reasons for this are several. First, chips are prone to sogginess and staleness when exposed to atmospheric moisture over 24 hours or less. Second, it is challenging to segregate and keep the chips from coming in contact with customers and pests when dispensing from bulk product. For example, an open party bowl of chips. Third, it is difficult to avoid breakage as the chips are dispensed. Finally, given all the issues previously described, it is difficult to design a system that is independent of snack type, snack size, and container used to catch the dispensed snack.

A need exists to build a chip dispenser independent of chip size and chip ingredients. Further, a need exists to build a device that is capable of keeping the chip crisp for at least 24 hours, reduce chip breakage, and keep the chip clean of germs and pests.

SUMMARY

Aspects and embodiments of the present invention are set out in the appended claims. These and other aspects and embodiments of the invention are also described herein.

The disclosed device provides a universal dispenser of snacks. Specifically, the dispenser may be used for any chip type and size, regardless of the presence or absence of seasoning. The snack dispenser is touchless and seals the bulk product in a food zone away from the machinery and outside environment. Additionally, the snack dispenser may include sensors that detect the presence of a receiving container to catch the dispensed chips. Further the snack dispenser may include a second sensor that detects when the receiving container is sufficiently filled. In this manner, the device is capable of operating without customer input.

The snack dispenser is a universal snack dispenser. Accordingly, snacks introduced into the snack dispenser may be selected from chips, pretzels, Cheetos®, crackers, and the like. In some embodiments, the snack includes seasoning. In some embodiments, the snacks are chips. In some embodiments, the snacks are corn-based chips. In some embodiments, the snacks are potato based chips. In some embodiments, the snacks are vegetable chips.

In some embodiments, a snack dispenser has i) a food zone and ii) a non-food zone. The food zone and non-food zone are completely separate. In some embodiments, the food zone is defined by a chamber and the non-food zone is contained in one or more housings. In some embodiments, the chamber includes a slide, a conveyor belt, a dispensing chute, a flip lid, and a heating element. In one embodiment, the snack dispenser further includes a sensor. In some embodiments, the snack dispenser may include at least three sensors.

In some embodiments, the snack dispenser is configured to keep the snack crisp for at least 24 hours. In some embodiments, the snack dispenser is configured to keep the snack crisp for at least 12 hours. In some embodiments, the snack dispenser is configured to control the atmospheric moisture content within the chamber.

In some embodiments, the snack dispenser is configured to dispense the snack without breakage. In some embodiments, the snack dispenser is configured to dispense chips without breakage. In some embodiments, the snack dispenser is configured to dispense chips with a reduced risk of breakage.

In some embodiments, the snack dispenser may include a sensor to detect the presence of a receiving container. In some embodiments, the snack dispenser detects the presence of a receiving container without input from the customer (e.g., there are no buttons or digital screens for a customer to touch). In some embodiments, the snack dispenser detects when a sufficient amount of snack has been dispensed into the receiving container. In some embodiments, the snack dispenser detects when a sufficient amount of snack has been dispensed without input from the customer. In some embodiments, the snack dispenser is configured to detect a receiving container and a sufficient amount of snack dispensed independent of the type of receiving container used to catch the dispensed snack and independent of the type of snack dispensed.

In some embodiments, it is envisioned that a customer approaches the snack dispenser and places a receiving container in proximity to the dispenser. In some embodiments, a tray provides the location for the customer to place the receiving container. Once the snack dispenser detects the presence of the receiving container, the machine begins the process of dispensing snack from inside the chamber to the receiving container without input from the customer. The amount of snack to be dispensed is based on the available volume within the receiving container. The snack dispenser stops dispensing when it detects that a sufficient amount of snack has dispensed. The customer then removes the receiving container sufficiently filled with a crisp, consumable snack.

The invention extends to methods, systems, kits of parts and apparatus substantially as described herein and/or as illustrated with reference to the accompanying figures.

The invention extends to any novel aspects or features described and/or illustrated herein. In addition, apparatus aspects may be applied to method aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

BRIEF DESCRIPTION OF THE DRAWINGS

The following description accompanies the drawings, all given by way of non-limiting examples that may be useful to understand the disclosed devices. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

A universal snack dispenser 10 is disclosed wherein the geometry of the components are configured to reduce breakage of the snack as it travels through the dispenser to a waiting receiving container 34.

Figure 1:
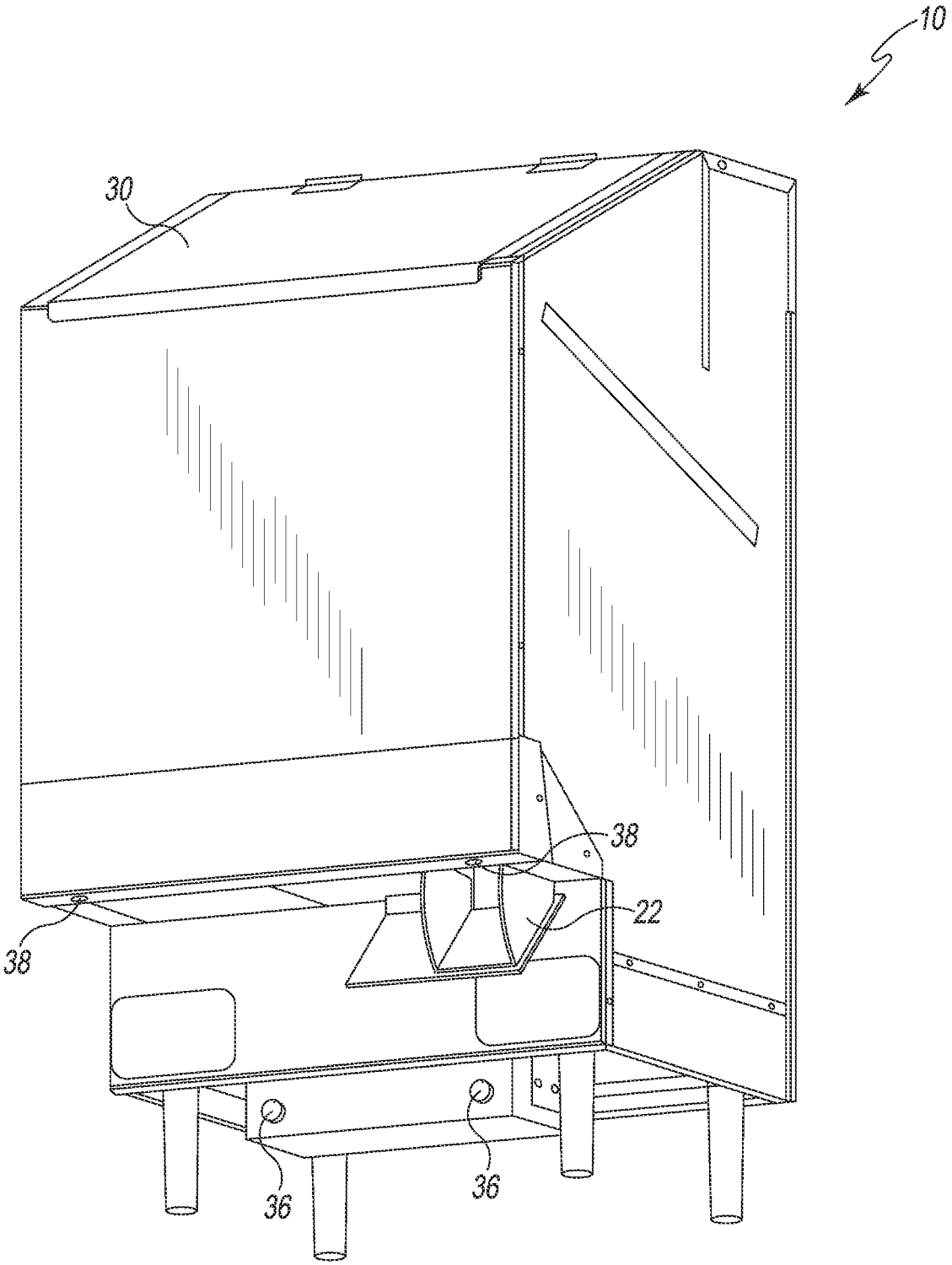
FIG. 1 is a perspective front view of an illustrative embodiment of a dispenser.
Figure 2:
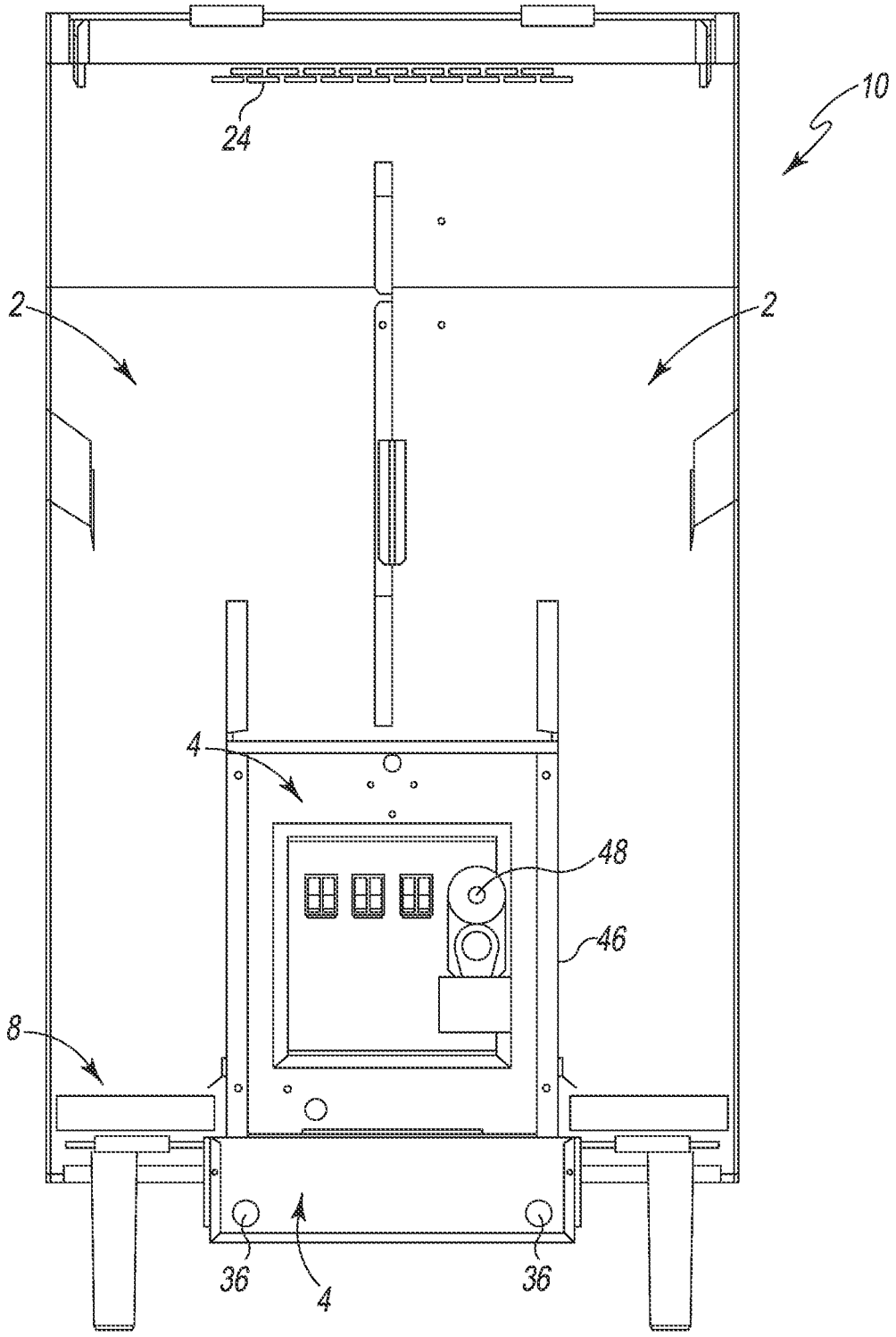
FIG. 2 is a cut away perspective from the front illustrating the food zones and non-food zones.

In an illustrative aspect, a universal snack dispenser 10 is provided. Referring to FIG. 1 and FIG. 2, the snack dispenser 10 comprises i) a food zone 2 and ii) a non-food zone 4. The non-food zone 4 is separated from the food zone 2 by a housing 46. In some embodiments, the snack dispenser 10 may include two non-food zones 4. In some embodiments, the snack dispenser 10 may include three non-food zones 4. In some embodiments, the snack dispenser 10 may include four non-food zones 4.

Figure 3:
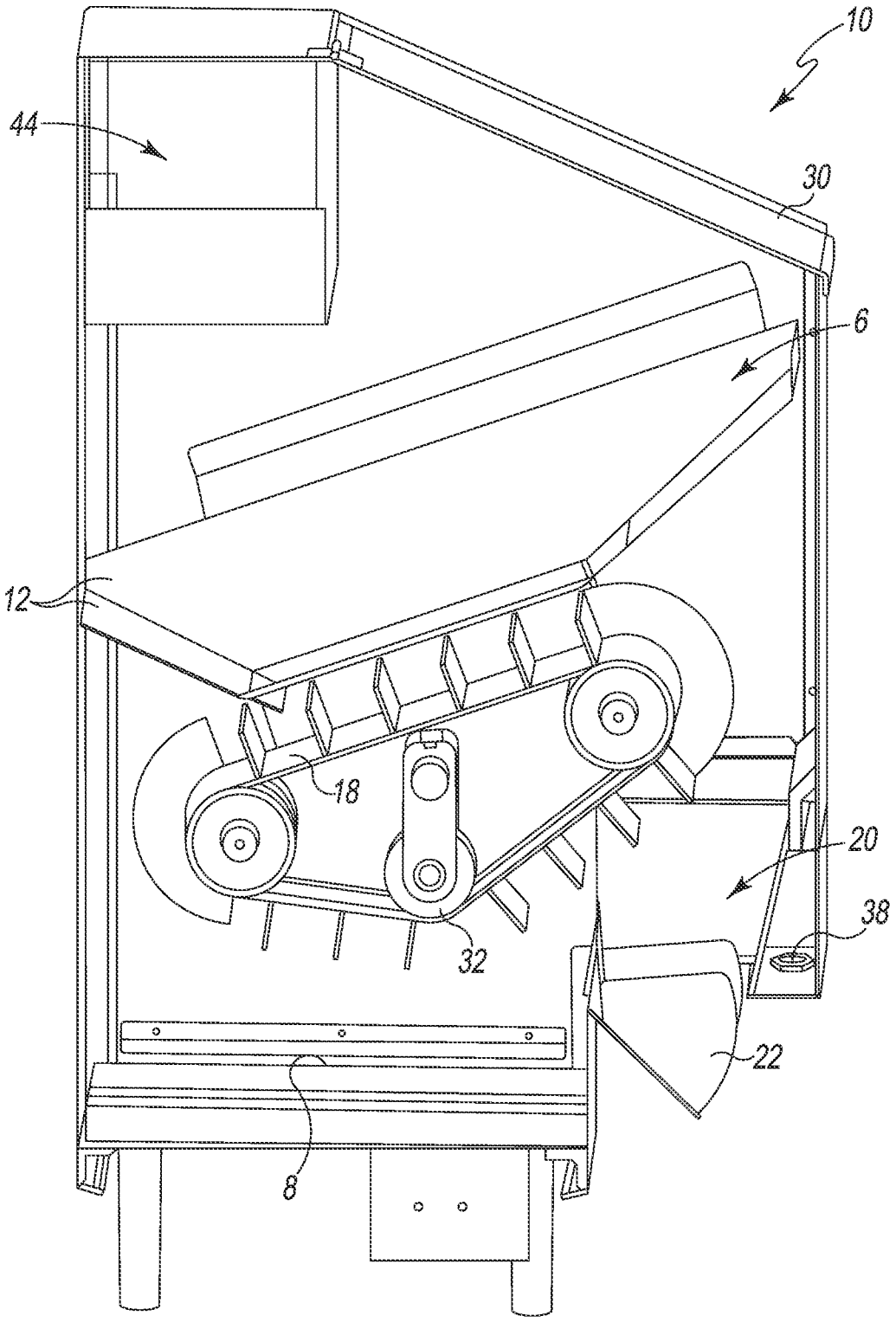
FIG. 3 is a cut-away side view of the chamber, duct, and second sensor.

Referring to FIG. 3, in some embodiments, the food zone 2 comprises a chamber 6 having a chamber base 8. In some embodiments, the chamber 6 further comprises a slide 12, a conveyor belt 18, a dispensing chute 20, a flip lid 22, and a radiative heating element 42. In some embodiments, the radiative heating element 42 is a halogen lamp.

Figure 5:
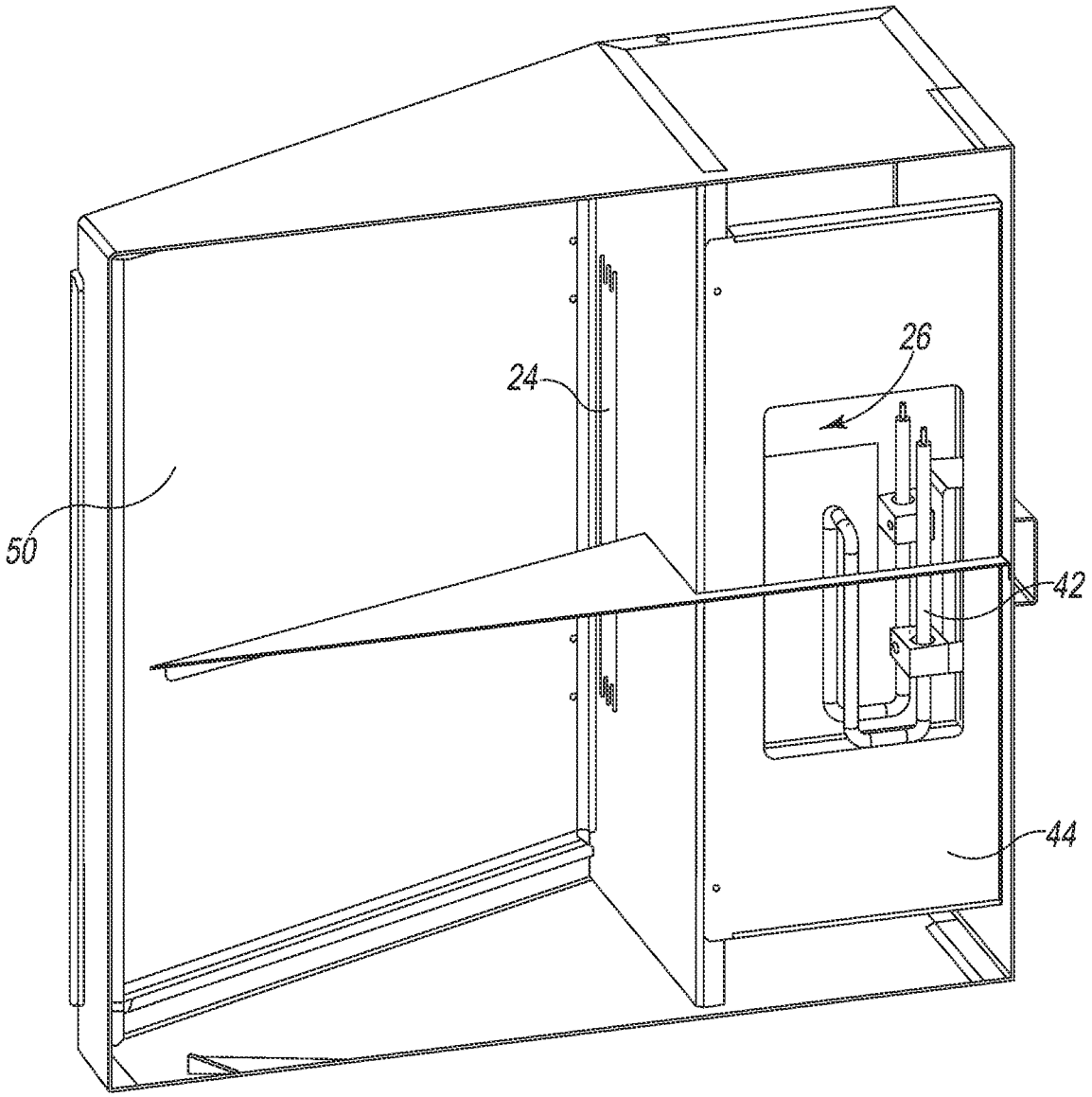
FIG. 5 is a cut-away view looking up into the dispenser showing the air inlet and air outlet.

Referring to FIG. 3 and FIG. 5, in some embodiments, the chamber 6 comprises a slide 12, a conveyor belt 18, a dispensing chute 20, and a flip lid 22. In some embodiments, the chamber 6 further comprises an air inlet 24, and an.

Figure 8:
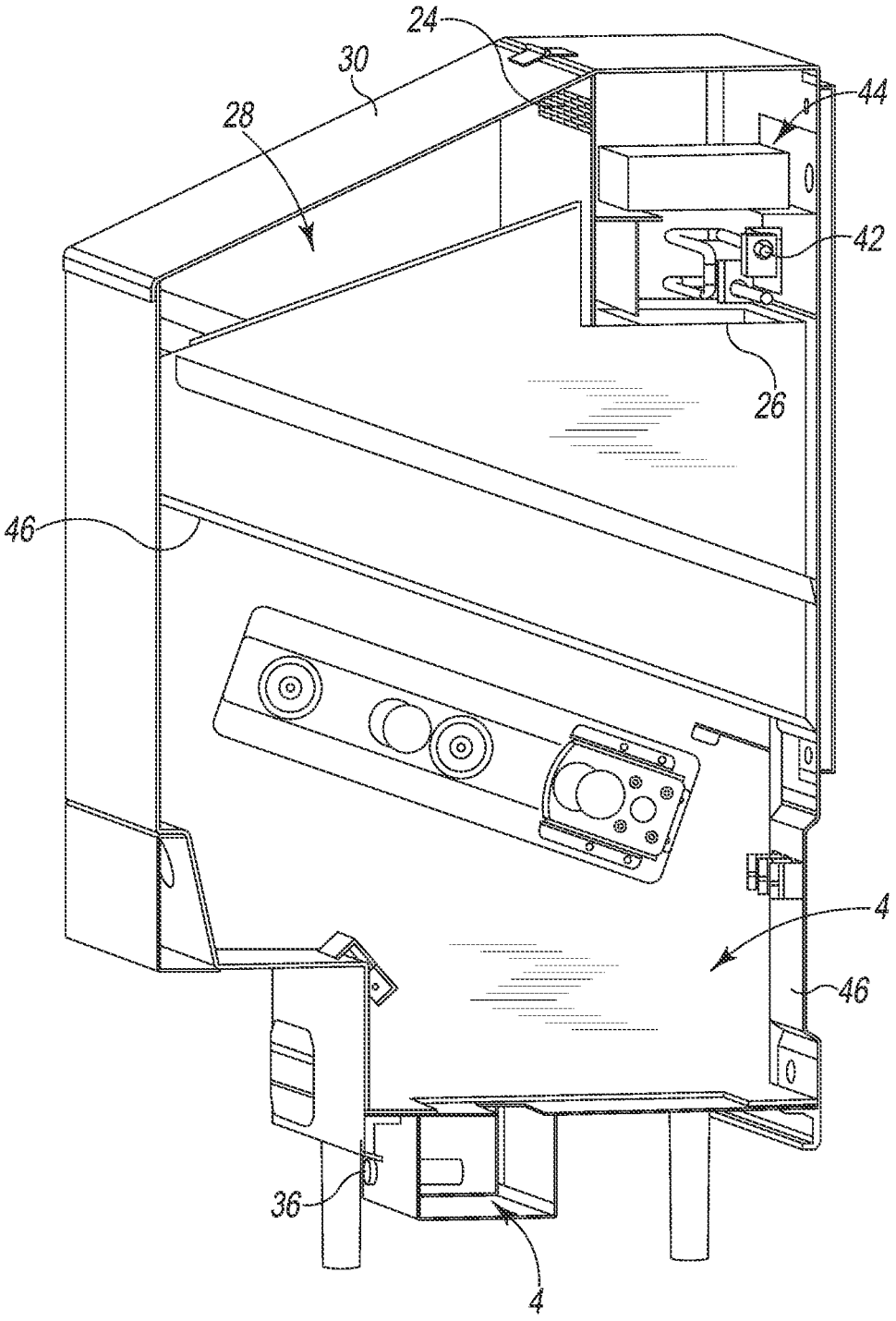
FIG. 8 is a cut-away view of three non-food zones.
Figure 9:
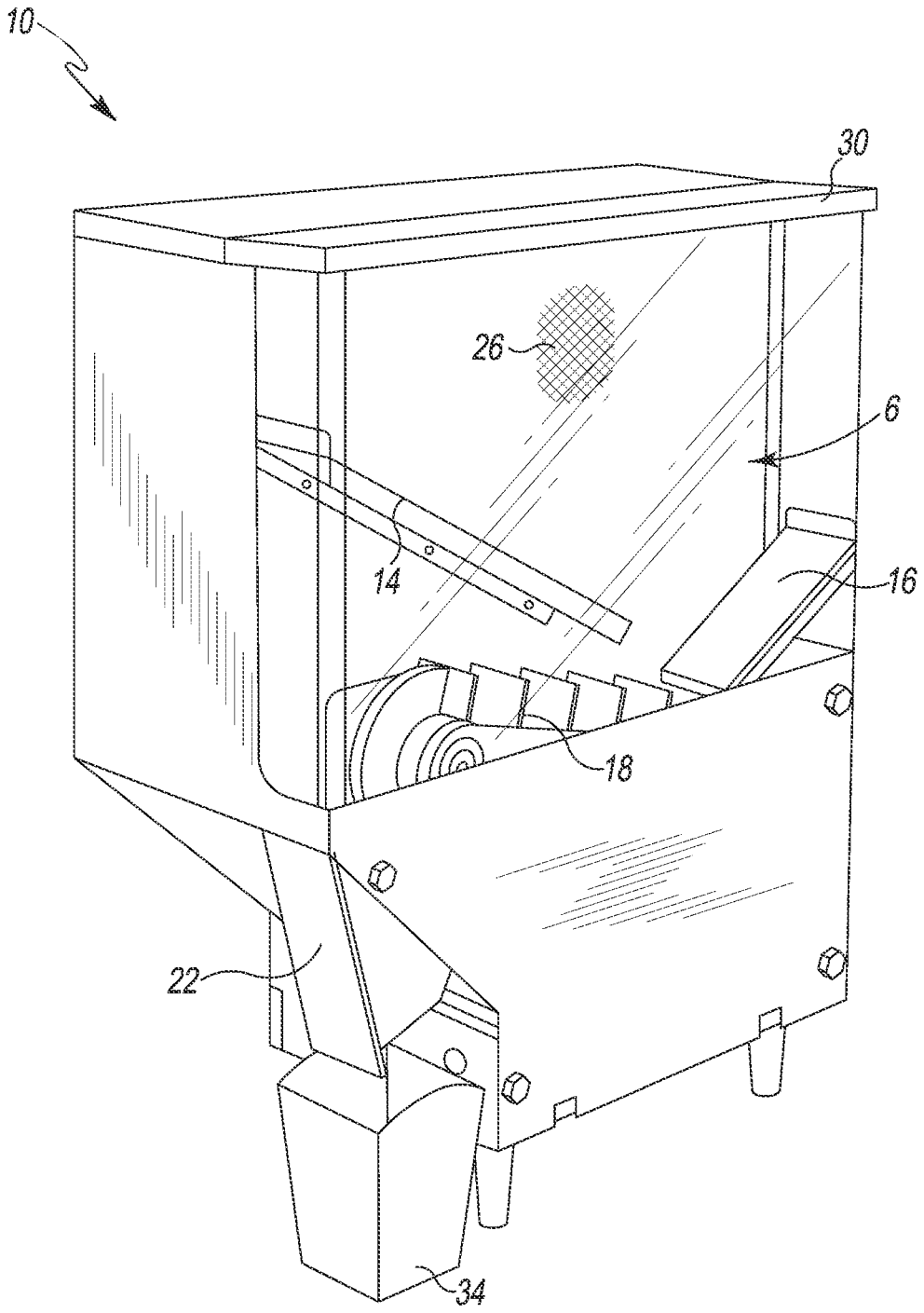
FIG. 9 is a perspective view of an illustrative embodiment of a dispenser.
Figure 10:
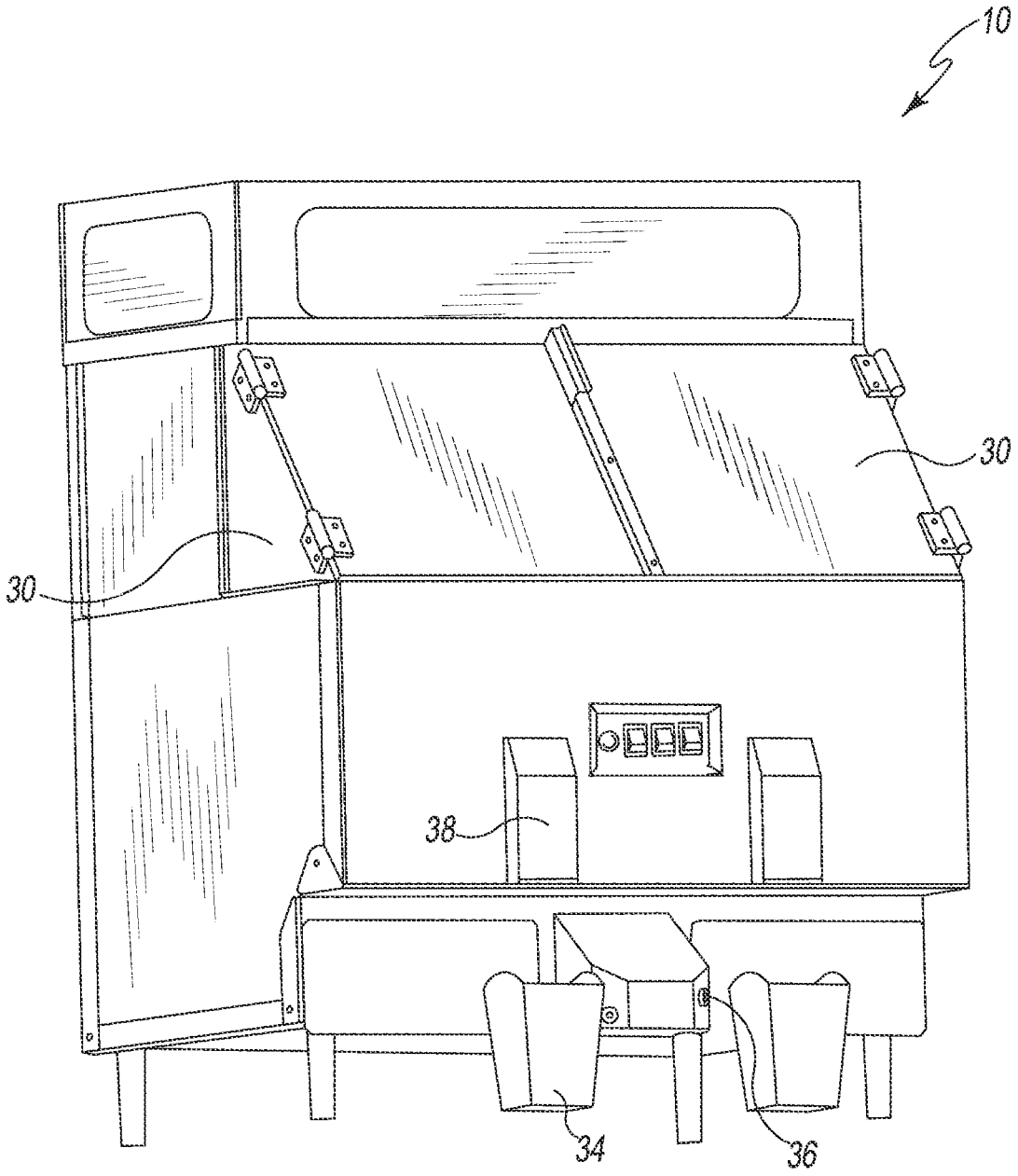
FIG. 10 is a perspective view of an illustrative embodiment of a dispenser.

Referring to FIG. 3, in some embodiments, the food zone 2 further includes an access opening 28 for introducing snacks into the chamber 6. In some embodiments, the access opening 28 further comprises a cover 30 configured to seal the access opening 28 from the outside atmosphere. In some embodiments, the cover 30 is selected from a lid, a hinged door, or a cap. In some embodiments, the access opening 28 is located at the top of the chamber 6. In some embodiments, the access opening 28 is located on a side of the chamber 6. Exemplary embodiments of a cover 30 are illustrated in FIG. 8, FIG. 9, and FIG. 10.

In one aspect, the cover 30 is removed or opened to reveal the access opening 28. A bulk quantity of snack is introduced to the chamber 6 by way of the access opening 28. The snack first makes contact with a slide 12. As will be described in more detail below, the slide 12 is configured to transport the snack from the access opening 28 down to the conveyor belt 18. The angle of slide 12 and the conveyor belt 18 reduce stress on the snack resulting in reduced breakage. The conveyor belt 18 is configured to transport the snack to the dispensing chute 20. In one aspect the dispensing chute 20 is positioned below the conveyor belt 18 so that the snack can be dropped from the conveyor belt 18 into the dispensing chute 20. The width of the dispensing chute and motion of the conveyor belt 18 are configured to introduce the least amount of stress possible on the snack, thus reducing breakage. The dispensing chute 20 is coupled to the flip lid 22. The flip lid 22 is positioned underneath the dispensing chute 20 to transport snack from the conveyor belt 18, through the dispensing chute 20, and to the flip lid 22. In some aspects, the flip lid 22 is in an open position before the conveyor belt 18 begins moving snack from the slide 12 to the dispensing chute 20. The flip lid 22 transports the snack from the dispensing chute 20 to the receiving container 34.

Figure 4:
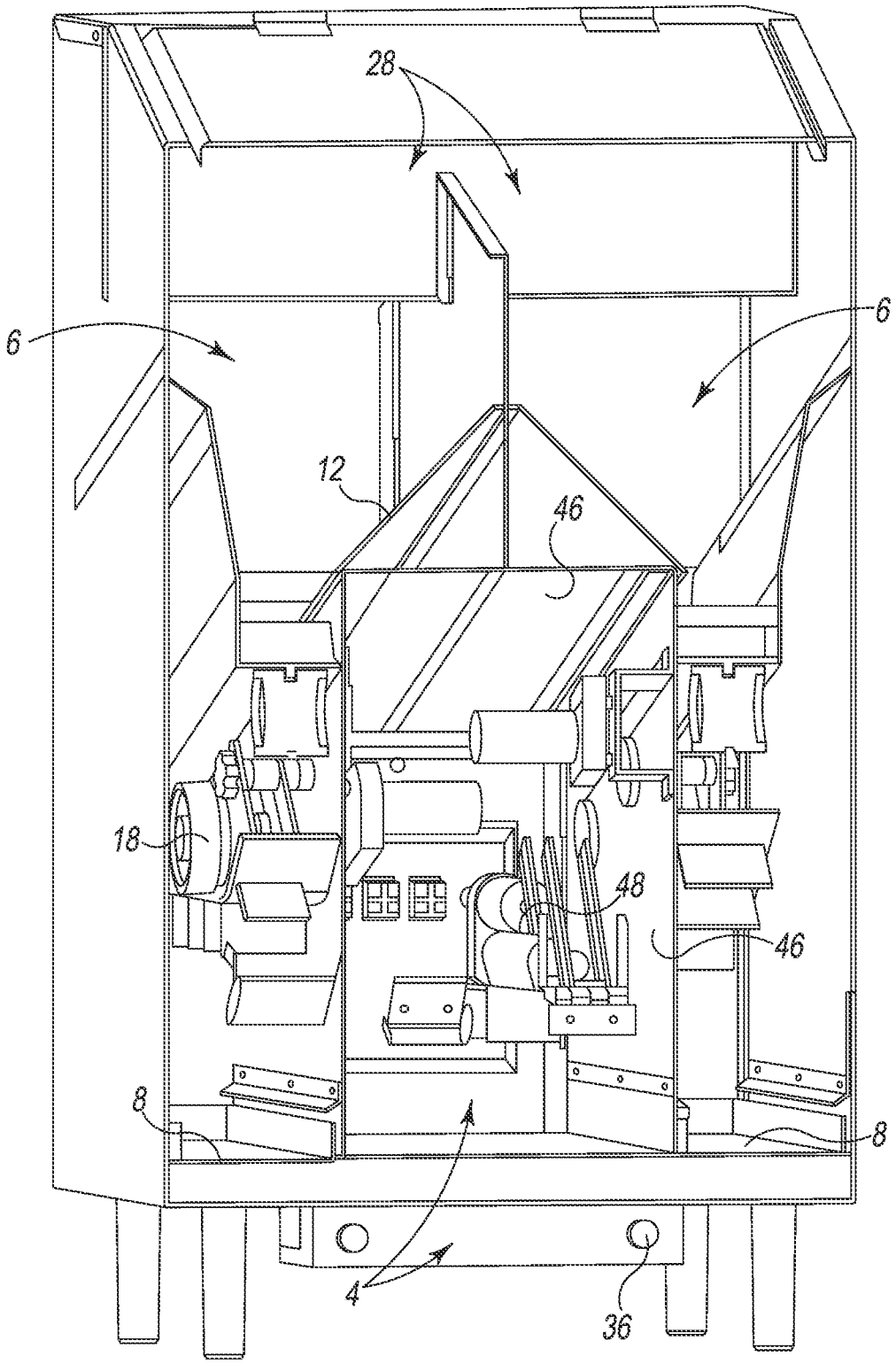
FIG. 4 is a cut-away perspective showing the chamber components and housing components.

In some embodiments, the air inlet 24 and the air outlet 26 are coupled to the non-food zone 4. Referring to FIG. 4 and FIG. 8, in some embodiments, the air inlet 24 is located at the chamber base 8 and the air outlet 26 is located at the top of the chamber 6. Referring to FIG. 4 and FIG. 5, in some embodiments, the air inlet 24 and the air outlet 26 are located at the top of the chamber 6. In some embodiments, the air inlet 24 and the air outlet 26 each include a screen as illustrated in FIG. 6 and FIG. 7.

Figure 6:
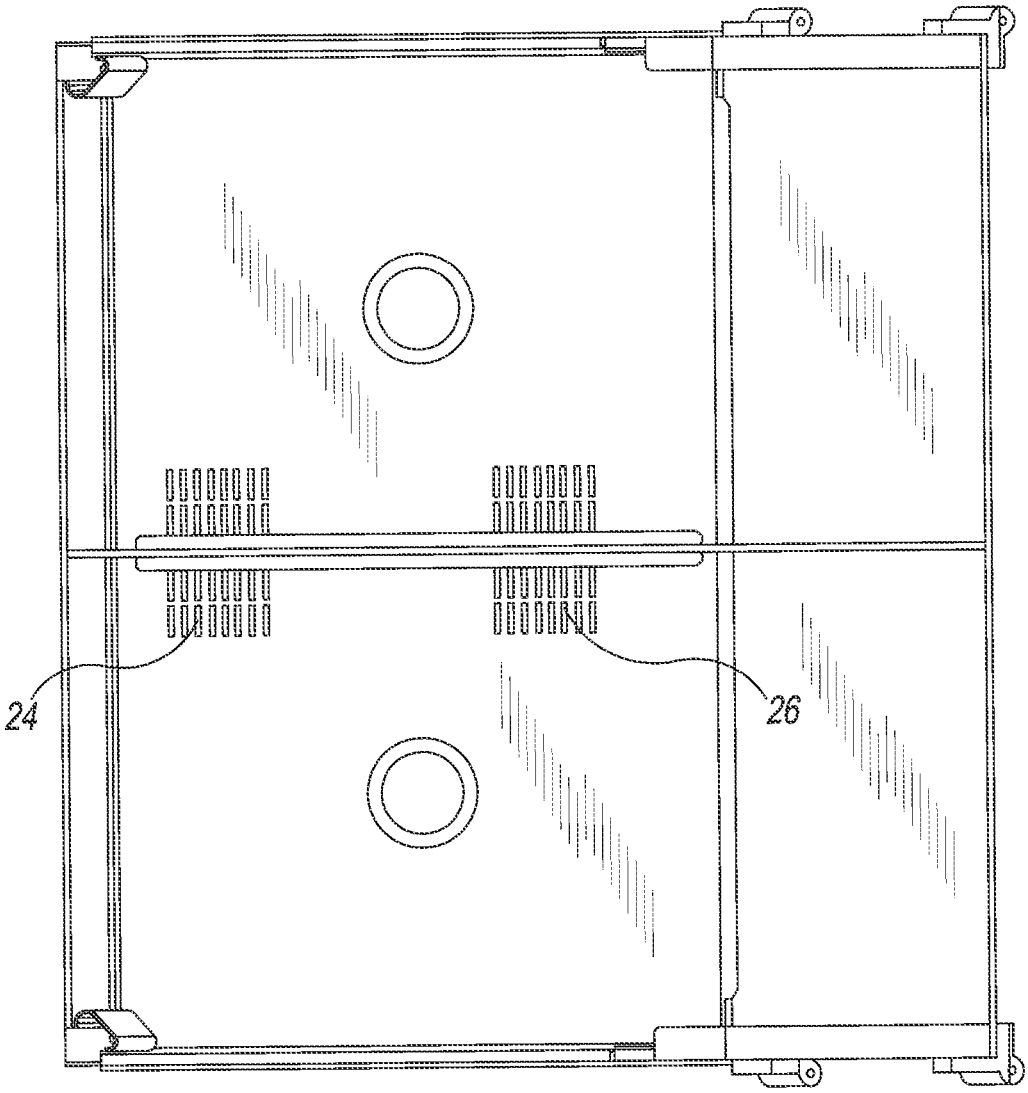
FIG. 6 is a cut-away view looking up into a dispenser showing another embodiment of the air inlet and air outlet.
Figure 7:
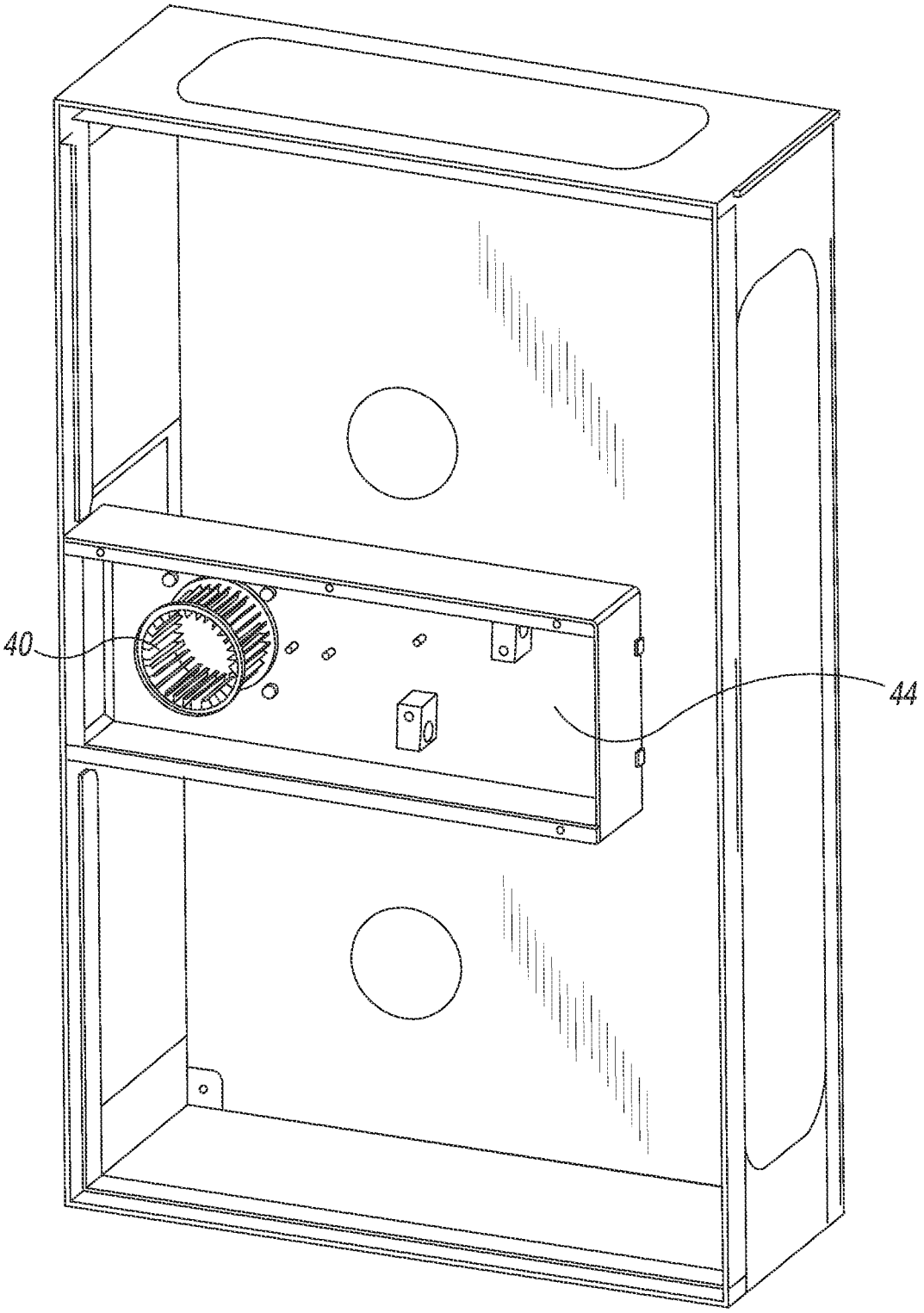
FIG. 7 is a cut-away view showing an embodiment of a duct and fan.

Referring to FIG. 4, FIG. 5, and FIG. 6, in some embodiments, the air inlet 24 is contained in a duct 44. In some embodiments, the duct 44 is separated from the food zone 2 and includes a fan 40 and a heating element 42 as illustrated in FIG. 6 and FIG. 7.

In some embodiments, the air inlet 24 delivers hot air into the chamber 6. The hot air is capable of maintaining a crisp snack by removing moisture from the air in the chamber 6. In some embodiments, the snack dispenser 10 further includes a moisture sensor to detect and maintain a constant atmospheric moisture percentage with the chamber 6. In some embodiments, the temperature of the heating element 42 is adjusted in response to the moisture content in the atmosphere in the chamber 6 or outside the chamber 6. In some embodiments, the detection of the chamber's moisture content and the temperature of the heating device is controlled by a printed circuit board. In some embodiments, the printed circuit board is located in the non-food zone 4.

In some embodiments, the duct 44, the air inlet 24, the chamber 6, and the air outlet 26 are in fluid communication. In some embodiments, a vent is coupled to the air outlet 26 to vent moist air.

Referring to FIG. 7, in some embodiments, the heating element 42 is a heating coil. In some embodiments, the fan 40 continuously cycles the hot air into the chamber 6. In some embodiments, the hot air is configured to remove moisture from the food zone 2. In some embodiments, the hot air maintains the chamber 6 at about 40° C. In some embodiments, the hot air maintains the chamber 6 between about 35° C. to about 55° C. In some embodiments, the hot air maintains the chamber 6 between about 40° C. and about 45° C.

In some embodiments, the chamber 6 is made of food grade materials acceptable to food safety standards. In some embodiments, the chamber 6 is made of plastic, metal, ceramic, glass, or a combination thereof. In some embodiments, the plastic is acrylic. In some embodiments, the metal is aluminum or steel. In some embodiments, the chamber 6 is configured to hold between about 0.5 kg to 6 kg of snack. In some embodiments, the chamber 6 is configured to hold between about 0.5 kg to 4 kg of snack.

The slide 12 is configured to receive and reduce snack breakage as the snack is transport through the snack dispenser 10. The position and angle of the slide 12, plays a part in lowering the impact of force felt by the snack and maintain a smooth transport through the snack dispenser 10. In some embodiments, the slide 12 is made of plastic, metal, ceramic, or a combination thereof.

Figure 11:
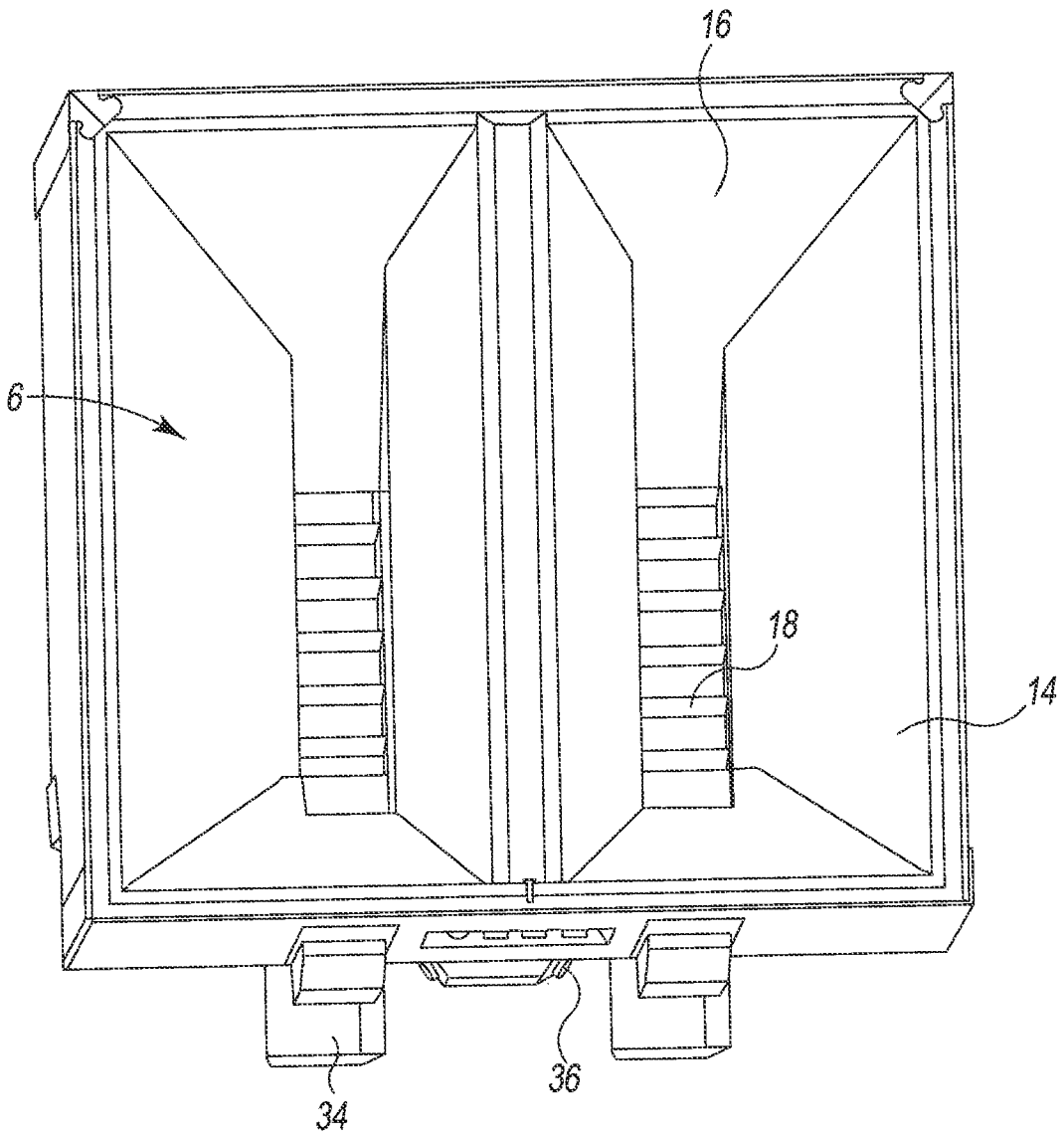
FIG. 11 is a cut-away perspective looking down into the dispenser showing the chamber, slide, and conveyor belt.

Referring to FIG. 3, FIG. 9, and FIG. 11, in some embodiments, the slide 12 is configured to receive the snack from the access opening 28 and is positioned to slope down at an angle away from the access opening 28. In some embodiments, the slide 12 includes a first slide 14 that is configured to receive and deliver the snack to a second slide 16. Referring to FIG. 9, in some embodiments, the second slide 16 is positioned to slope down in a direction opposite the first slide 14. Referring to FIG. 11, in some embodiments, the second slide 16 is positioned perpendicular to the first slide 14. In some embodiments, the first slide 14 is positioned above the second slide 16. In some embodiments, the first slide 14 and the second slide 16 are tapered down to the conveyor belt 18. In some embodiments, the first slide 14 and the second slide 16 are configured to deliver the snack to the conveyor belt 18. In some embodiments, the second slide 16 is configured to deliver the snack from the first slide 14 to the conveyor belt 18.

In some embodiments, the slide 12 is sloped downward at an angle of about 30° to about 70° from the chamber base 8. In some embodiments, the slide 12 is sloped downward at an angle of about 60°, about 55°, about 50°, or about 45° from the chamber base 8. In some embodiments, when the slide 12 includes the first slide 14 and second slide 16, the second slide 16 is sloped downward at an angle of about 30° to about 70° from the chamber base 8. In some embodiments, the second slide 16 is sloped downward at an angle of about 60°, about 55°, about 50°, or about 45° from the chamber base 8.

Figure 12:
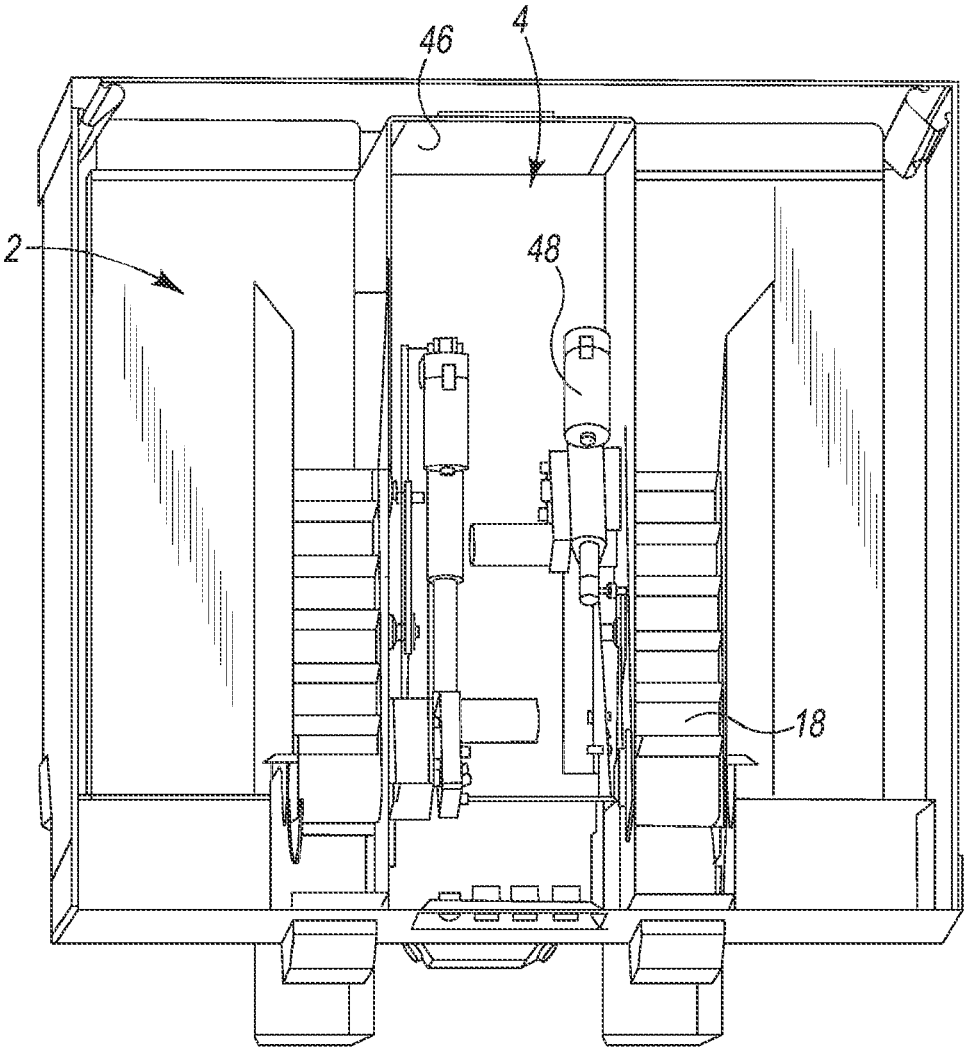
FIG. 12 is a cut-away perspective looking down into the dispenser showing the motor in the non-food zone coupled to the conveyor belt in the food zone.

Referring to FIG. 12, in some embodiments, the conveyor belt 18 is driven by a motor 48 located in the non-food zone 4. In some embodiments, the conveyor belt 18 is a bucket conveyor belt. In some embodiments, the conveyor belt 18 includes buckets configured to receive a specified amount of snacks. Referring to FIG. 3 and FIG. 11, in some embodiments, the angle from the slide 12 or second slide 16 to the conveyor belt 18 is configured to reduce snack breakage by minimizing the force of impact exerted on the snack as it is delivered to the conveyor belt 18.

In some embodiments, the conveyor belt 18 is made of a food grade material. In some embodiments, the conveyor belt 18 includes a tension control mechanism 32 to prevent snack debris or powdered spices from clogging the conveyor belt 18 mechanism. As shown in FIG. 3, in some embodiments, the tension control mechanism 32 includes a spring loaded third roller to maintain tension in the conveyor belt 18.

Referring to FIG. 3, in some embodiments, the conveyor belt 18 is coupled to the dispensing chute 20. In some embodiments, the dispensing chute 20 is warmed by the hot air, and wherein the hot air maintains the dispensing chute 20 at about 40° C. to about 50° C. In some embodiments, the geometry of the dispensing chute 20 reduces snack breakage. For example, in some embodiments, the chute's width and depth match the size of the flip lid 22 to avoid surfaces for the snack to crack on. Further, in some embodiments, the area within the dispensing chute 20 is large enough to accommodate any size snack without concern for clogging or crushing. In some embodiments, the dispensing chute 20 is configured to deliver the snack through the flip lid 22 into the receiving container 34. Referring to FIG. 3, in an illustrative embodiment, the dispensing chute 20 is located above the flip lid 22.

Referring to FIG. 3 and FIG. 10, in some embodiments, the flip lid 22 is configured to open in the presence of a receiving container 34. In some embodiments, the receiving container 34 may be selected from a vessel, a plate, a carton, a cup, a bowl, a bag, a clam shell packaging, or a box. In some embodiments, the flip lid 22 has a width of about 65 mm to about 85 mm. In some embodiments, the width is about 70 mm to about 75 mm. In some embodiments, the width is 74.5 mm.

In some embodiments, the flip lid 22 is configured to open to an opened position when a first sensor 36 senses a receiving container 34, and close to a closed position when a second sensor 38 determines the receiving container 34 has a sufficient amount of snack. Herein, the term "sufficient amount of snack" means wherein the receiving container 34 is filled at least about 70%, at least about 75%, at least about 80%, at least about 85%, at least about 90%, at least about 95%, or at least about 100% with the dispensed snack. The percentage full can be programmed into the snack dispenser 10 software on the printed circuit board. In some embodiments, when the flip lid 22 is in the closed position, the food zone 2 is sealed from outside elements. Referring to FIG. 3, in some embodiments, the flip lid 22 is coupled to a first sensor 36. The first sensor 36 is coupled to the printed circuit board in the non-food zone 4. In some embodiments, the first sensor 36 is configured to detect the presence of a receiving container 34. As illustrated in FIG. 3 and FIG. 10, the sensor is activated when the receiving container 34 is placed under the flip lid 22. In some embodiments, the flip lid 22 is coupled to the second sensor 38. The flip lid 22 moves to the closed position once the second sensor 38 detects a sufficient amount of snack has been dispensed into the receiving container 34.

In some aspects, the flip lid 22 opens to a position having an angle of between about 75° to about 110° to a tray. In some embodiments, the flip lid 22 opens to an opened position at a slight angle (i.e., not 90°) to the tray. In this manner, the flip lid 22 transports the snack from the dispensing cute 20 to the receiving container 34 in a manner that reduces the force and stress on the snack compared to the snack being dropped straight down from the dispenser.

In some embodiments, the first sensor 36 is coupled to the motor 48 that drives the conveyor belt 18. In one aspect, once the first sensor 36 detects the presence of a receiving container 34, the flip lid 22 opens and the motor 48 drives the conveyor belt 18. Once the second sensor 38 detects that a sufficient amount of snack has been dispensed, the motor 48 stops turning and the flip lid 22 closes to the closed position.

In some embodiments, the first sensor 36 and the second sensor 38 are coupled to the non-food zone 4. In some embodiments, the first sensor 36 is located below the flip lid 22. Referring to FIG. 3 and FIG. 10, in some embodiments, the second sensor 38 is located in front of the flip lid 22. In some embodiments, the first sensor 36, the second sensor 38, or both are infrared (IR) sensors.

In some embodiments, the snack dispenser 10 further includes a tray positioned below the flip lid 22. The tray is configured to receive the receiving container 34. In some embodiments, the tray is detachable. In some embodiments, the tray is made of metal or plastic. In some embodiments, the tray has a flat surface for placing the receiving container in a position ready to accept dispensed snack. In some embodiments, the tray comprises raised ridges to hold the receiving container 34 in place or to prevent the receiving container 34 from sliding or falling over. In some embodiments, the tray can fold from a vertical or nearly vertical closed position to a flat open position. In the open position, the tray is capable of receiving a receiving container 34. In some aspects, the distance of the tray to the flip lid 22 can be adjusted to further reduce the forces felt by the snack as it is dispensed into a receiving container 34.

In some embodiments, the non-food zone 4 is sealed from the food zone 2. Referring to FIG. 2, FIG. 4, and FIG. 12, in some embodiments, the non-food zone 4 comprises a housing 46, a motor 48, electronics, and a printed circuit board. In some embodiments, the housing 46 is made of sheet metal or plastic or a combination thereof.

In some embodiments, the motor 48 is coupled to the first sensor 36 and second sensor 38. In some aspects, the first sensor 36 provides a signal for the motor 48 to drive and the second sensor 38 provides a signal for the motor 48 to stop. In some embodiments, the motor 48 is programmed on a timing mechanism to run for a set amount of time when the first sensor 36 is activated.

In some embodiments, the snack dispenser 10 comprises two food zones 2 and one non-food zone 4. In some embodiments, the snack dispenser 10 comprises two first sensor 36*s* and two second sensors 38. In some embodiments, the snack dispenser 10 further comprises two trays configured to receive receiving container 34*s*. In some embodiments, the two food zones 2 comprise two access openings 28 covered by a single lid. In some embodiments, the two foods zones 2 may dispense the same snack or different snacks. In some embodiments, the non-food zone 4 is configured to allow one food zone 2 to dispense a snack, while the second food zone 2 is not active. In other embodiments, the non-food zone 4 is configured to dispense snacks from more than one food zone 2 at or nearly at the same time. In some embodiments, wherein the snack dispenser includes two food zones 2, the non-food zone 4 may use a single motor 48 or two separate motors 48 to drive the conveyor belts 18. In some embodiments, the first conveyor belt 18 operates independently of the second conveyor belt 18.

A method of dispensing a snack on demand from a snack dispenser 10 is provided. The method comprises i) receiving a signal that a receiving container 34 is present; ii) opening a flip lid 22; iii) engaging a motor 48 to turn a conveyor belt 18; iv) receiving a signal that the receiving container 34 has a sufficient amount of snack; v) disengaging the motor 48; and vi) closing the flip lid 22.

The following numbered embodiments are contemplated and are non-limiting:

Clause 1. A snack dispenser 10 comprising i) a food zone 2 and ii) a non-food zone 4.

Clause 2. The snack dispenser 10 of clause 1, wherein the food zone 2 comprises a chamber 6.

Clause 3. The snack dispenser 10 of clause 2, wherein the chamber 6 comprises a slide 12, a conveyor belt 18, a dispensing chute 20, a flip lid 22, and a radiative heating element 42.

Clause 4. The snack dispenser 10 of clause 3, wherein the radiative heating element 42 is a halogen lamp.

Clause 5. The snack dispenser 10 of clause 2, wherein the chamber 6 comprises a slide 12, a conveyor belt 18, a dispensing chute 20, a flip lid 22, an air inlet 24, and an air outlet 26.

Clause 6. The snack dispenser 10 of clauses 2-5, wherein the food zone 2 further comprises an access opening 28 for introducing snacks into the chamber 6.

Clause 7. The snack dispenser 10 of clause 6, wherein the access opening 28 further comprises a cover 30 configured to seal the access opening 28 from the outside atmosphere, and wherein the cover 30 is selected from a lid, a hinged door, or a slide and lock top.

Clause 8. The snack dispenser 10 of clauses 6 and 7, wherein the access opening 28 is located at the top of the chamber 6.

Clause 9. The snack dispenser 10 of clause 5, the air inlet 24 and the air outlet 26 are coupled to the non-food zone 4.

Clause 10. The snack dispenser 10 of clause 9, wherein the air inlet 24 is located at or near the chamber base 8 and the air outlet 26 is located at the top of the chamber 6.

Clause 11. The snack dispenser 10 of clause 5, wherein the air inlet 24 and the air outlet 26 are located at the top of the chamber 6.

Clause 12. The snack dispenser 10 of clauses 5 and 9-11, wherein the air inlet 24 and the air outlet 26 include a screen.

Clause 13. The snack dispenser 10 of clauses 5 and 9-12, wherein the air inlet 24 is coupled to a duct 44.

Clause 14. The snack dispenser 10 of clause 13, wherein the duct 44 is separated from the food zone 2 and includes a fan 40 and a heating element 42.

Clause 15. The snack dispenser 10 of clauses 5 and 9-14, wherein the air inlet 24 delivers hot air into the chamber 6 and the hot air exits through the air outlet 26.

Clause 16. The snack dispenser 10 of clauses 13-15, wherein the duct 44, the air inlet 24, the chamber 6, and the air outlet 26 are in fluid communication.

Clause 17. The snack dispenser 10 of clause 5, wherein a vent is coupled to the air outlet 26.

Clause 18. The snack dispenser 10 of clauses 14-17, wherein the heating element 42 is a heating coil.

Clause 19. The snack dispenser 10 of clauses 13-18, wherein the duct 44 cycles hot air into the chamber 6.

Clause 20. The snack dispenser 10 of clause 19, wherein the hot air is configured to remove moisture from the food zone 2.

Clause 21. The snack dispenser 10 of clauses 19-20, wherein the hot air maintains the chamber 6 at about 40° C.

Clause 22. The snack dispenser 10 of clauses 2-21, wherein the chamber 6 is made of food grade materials acceptable to food safety standards including plastic, metal, ceramic, glass, or a combination thereof.

Clause 23. The snack dispenser 10 of clause 22, wherein the plastic is acrylic or polycarbonate.

Clause 24. The snack dispenser 10 of clause 22, wherein the metal is aluminum or steel.

Clause 25. The snack dispenser 10 of clause 2-23, wherein the chamber 6 is configured to hold between about 0.5 kg to 6 kg of snack.

Clause 26. The snack dispenser 10 of clauses 3-25, wherein the slide 12 is configured to receive the snack from the access opening 28 and is positioned to slope down at an angle away from the access opening 28.

Clause 27. The snack dispenser 10 of clauses 3-26, wherein the slide 12 includes a first slide 14 that is configured to receive and deliver the snack to a second slide 16, wherein the second slide 16 is positioned to slope down in a direction opposite the first slide 14.

Clause 28. The snack dispenser 10 of clause 27, wherein the first slide 14 is positioned above the second slide 16.

Clause 29. The snack dispenser 10 of clauses 3-28, wherein the slide 12 is sloped downward at an angle of about 30° to about 70° from the chamber base 8.

Clause 30. The snack dispenser 10 of clauses 3-29, wherein the slide 12 is sloped downward at an angle of about 60° from the chamber base 8.

Clause 31. The snack dispenser 10 of clauses 3-30, wherein the slide 12 includes the first slide 14 and second slide 16, the second slide 16 is sloped downward at an angle of about 30° to about 70° from the chamber base 8.

Clause 32. The snack dispenser 10 of clause 31, wherein the second slide 16 is sloped downward at an angle of about 60° from the chamber base 8.

Clause 33. The snack dispenser 10 of clauses 31-32, wherein the second slide 16 slopes downward in the opposite direction to the first slide 14.

Clause 34. The snack dispenser 10 of clauses 27-33, the first slide 14 is positioned above and perpendicular to the second slide 16.

Clause 35. The snack dispenser 10 of clauses 27-34, wherein the first slide 14 and second slide 16 are tapered down to the conveyor belt 18.

Clause 36. The snack dispenser 10 of clauses 27-35, wherein the first slide 14 and the second slide 16 are configured to deliver the snack to the conveyor belt 18.

Clause 37. The snack dispenser 10 of clauses 3-36, wherein the conveyor belt 18 includes flights.

Clause 38. The snack dispenser 10 of clauses 3-37, wherein the conveyor belt 18 is a bucket conveyor belt.

Clause 39. The snack dispenser 10 of clauses 3-38, wherein the angles of the slide 12 are configured to reduce breakage of the snack.

Clause 40. The snack dispenser 10 of clauses 3-39, wherein the first slide 14 and second slide 16 are made of plastic, metal, ceramic, or a combination thereof.

Clause 41. The snack dispenser 10 of clauses 27-40, wherein the second slide 16 is configured to deliver the snack from the first slide 14 to the conveyor belt 18.

Clause 42. The snack dispenser 10 of clauses 3-41, wherein the conveyor belt 18 is driven by a motor 48 located in the non-food zone 4.

Clause 43. The snack dispenser 10 of clause 3-42, wherein the conveyor belt 18 includes buckets configured to receive a specified amount of snacks.

Clause 44. The snack dispenser 10 of clauses 3-43, wherein the angle from the slide 12 or second slide 16 to the conveyor belt 18 is configured to reduce snack breakage by minimizing the force of impact exerted on the snack as it is delivered to the conveyor belt 18.

Clause 45. The snack dispenser 10 of clauses 3-44, wherein the conveyor belt 18 is made of a food grade material.

Clause 46. The snack dispenser 10 of clauses 3-45, wherein the conveyor belt 18 includes a tension control mechanism 32 configured to prevent snack debris from clogging the conveyor belt 18 mechanism.

Clause 47. The snack dispenser 10 of clause 46, wherein the tension control mechanism 32 includes a spring loaded third roller to maintain tension in the conveyor belt 18.

Clause 48. The snack dispenser 10 of clauses 3-47, wherein the conveyor belt 18 is coupled to the dispensing chute 20.

Clause 49. The snack dispenser 10 of clauses 15-48, wherein the dispensing chute 20 is warmed by the hot air, and wherein the hot air maintains the dispensing chute 20 at about 40° C. to about 50° C.

Clause 50. The snack dispenser 10 of clauses 3-49, wherein the dispensing chute 20 is coupled to the flip lid 22.

Clause 51. The snack dispenser 10 of clauses 3-50, wherein the flip lid 22 is coupled to a first sensor 36 and a second sensor 38.

Clause 52. The snack dispenser 10 of clause 51, wherein the first sensor 36 and the second sensor 38 are coupled to the non-food zone 4.

Clause 53. The snack dispenser 10 of clauses 51-52, wherein the first sensor 36 and second sensor 38 are located below the flip lid 22 on the snack dispenser 10.

Clause 54. The snack dispenser 10 of clauses 51-53, wherein the first sensor 36 and second sensor 38 are IR sensors.

Clause 55. The snack dispenser 10 of clauses 3-54, wherein the flip lid 22 is configured to open in the presence of a receiving container 34.

Clause 56. The snack dispenser 10 of clause 55, wherein the receiving container 34 is selected from a tray, carton, cup, bowl, bag, or box.

Clause 57. The snack dispenser 10 of clauses 3-56, wherein the dispensing chute 20 is configured to deliver the snack through the flip lid 22 into the receiving container 34.

Clause 58. The snack dispenser 10 of clauses 3-57, wherein the dispensing chute 20's geometry reduces snack breakage.

Clause 59. The snack dispenser 10 of clauses 3-58, wherein the flip lid 22 has a width of about 65 mm to about 80 mm.

Clause 60. The snack dispenser 10 of clause 59, wherein the width is about 70 mm to about 75 mm.

Clause 61. The snack dispenser 10 of clause 60, wherein the width is 74.5 mm.

Clause 62. The snack dispenser 10 of clause 3-61, wherein the flip lid 22 is configured to open in an open position when the first sensor 36 senses a receiving container 34, and close in a close position when the second sensor 38 determines the receiving container 34 has a sufficient amount of snack.

Clause 63. The snack dispenser 10 of clause 51, wherein when the flip lid 22 is in the closed position, the food zone 2 is sealed from outside elements.

Clause 64. The snack dispenser 10 of clauses 55-63, wherein the food zone 2 further comprises a tray positioned below the flip lid 22, and wherein the tray is configured to receive the receiving container 34.

Clause 65. The snack dispenser 10 of clause 64, wherein the tray is detachable.

Clause 66. The snack dispenser 10 of clauses 64-65, wherein the tray is made of metal or plastic.

Clause 67. The snack dispenser 10 of clauses 1-66, wherein the non-food zone 4 comprises a housing 46, a motor 48, electronics, and a printed circuit board.

Clause 68. The snack dispenser 10 of clause 67, wherein the housing 46 is made of sheet metal or plastic.

Clause 69. The snack dispenser 10 of clauses 1-68, wherein the non-food zone 4 is sealed and separated from the food zone 2.

Clause 70. The snack dispenser 10 of clauses 67-69, wherein the motor 48 is coupled to the first sensor 36 and second sensor 38.

Clause 71. The snack dispenser 10 of clauses 67-70, wherein the motor 48 is programmed on a timing mechanism to run for a set amount of time when the first sensor 36 is activated.

Clause 72. The snack dispenser 10 of clauses 1-71, wherein the snack dispenser 10 comprises two food zones 2 and one non-food zone 4.

Clause 73. The snack dispenser 10 of clause 72, wherein the snack dispenser 10 comprises two first sensors 36 and two second sensors 38.

Clause 74. The snack dispenser 10 of clauses 72-73, wherein the snack dispenser 10 further comprises two trays configured to receive receiving containers 34.

Clause 75. The snack dispenser 10 of clause 72-74, wherein the two food zones 2 comprise two access openings 28 covered by a single lid.

Clause 76. A method of dispensing a snack on demand from a snack dispenser 10 as described in clauses 1-75 comprising: i) receiving a signal that a receiving container 34 is present; ii) opening a flip lid 22; iii) engaging a motor 48 to turn a conveyor belt 18; iv) receiving a signal that the receiving container 34 has a sufficient amount of snack; v) disengaging the motor 48; and vi) closing the flip lid 22.

Clause 77. The snack dispenser of clauses 1-76, wherein the geometries of the slide, conveyor belt, dispensing chute, and flip lid are configured to reduce chip breakage as a chip is dispensed from the snack dispenser.

The invention claimed is:

1. A snack dispenser comprising:

i) a chamber that defines a food zone configured to contain a snack product, the chamber comprising means for conveying the snack product from the food zone to a flip lid for dispensing, wherein the means for conveying includes a first slide sloped downwardly from a top of the chamber to a bottom of the chamber and being oriented perpendicularly to and opposite a second slide that is sloped downwardly from the top of the chamber to the bottom of the chamber such that the snack product travels from the first slide to the second slide and onto a conveyor belt to move the snack product to a dispensing chute that is in communication with the flip lid; and ii) a non-food zone physically separated from the food zone and including a motor for driving the conveying means, a first sensor configured to detect the presence of a receiving container and a second sensor configured to detect when a predetermined amount of snack has been dispensed into the receiving container, the wherein the flip lid moves to an opened position and the motor drives the conveying means when the receiving container is detected by the first sensor.

2. The snack dispenser of claim 1, wherein the motor is configured to stop driving the conveying means and the flip lid moves to a closed position when the second sensor detects the predetermined amount of snack is dispensed into the receiving container.

3. The snack dispenser of claim 1, wherein the chamber further comprises a fan and a heating element.

4. The snack dispenser of claim 3, wherein the heating element and fan are configured to cycle hot air into the chamber.

5. The snack dispenser of claim 3, further comprising a moisture sensor configured to detect the moisture content within the chamber.

6. The snack dispenser of claim 5, wherein a temperature of the heating element is adjusted in response to the detected moisture content.

7. The snack dispenser of claim 1, wherein the first sensor is positioned below the flip lid and the second sensor is positioned in front of the flip lid.

8. The snack dispenser of claim 6, wherein the first sensor, second sensor, moisture sensor, heating element, and motor are electrically connected to a circuit board.

9. The snack dispenser of claim 1, wherein the means of conveying and flip lid are angled in a manner to reduce breakage of the snack product as it is dispensed from the chamber to the receiving container.

10. The snack dispenser of claim 1 further comprising a dispensing chute, wherein the dispensing chute is coupled to the means of conveying and the flip lid.

11. The snack dispenser of claim 10, wherein the dispensing chute is warmed by hot air.

12. The snack dispenser of claim 10, wherein the dispensing chute has a geometry configured to reduce breakage of the snack product as it is dispensed from the chamber to the receiving container.

13. The snack dispenser of claim 6 further comprising a dispensing chute coupled to and extending between the means of conveying and the flip lid, wherein the dispensing chute is warmed by hot air, wherein the angle of each of the means of conveying, dispensing chute, and flip lid are configured to reduce breakage of the snack product as it is dispensed from the chamber to the receiving container.

14. The snack dispenser of claim 13, wherein the predetermined amount of snack is detected when the receiving container is at least 70% full of snack product.

15. The snack dispenser of claim 1, wherein the angle formed by the flip lid to the receiving container is not 90°.

* * * * *